US008826993B2

(12) United States Patent
Guidry et al.

(10) Patent No.: US 8,826,993 B2
(45) Date of Patent: Sep. 9, 2014

(54) DAMPING ASSEMBLY FOR DOWNHOLE TOOL DEPLOYMENT AND METHOD THEREOF

(75) Inventors: Christopher W. Guidry, Spring, TX (US); William A. Hered, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 320 days.

(21) Appl. No.: 13/189,156

(22) Filed: Jul. 22, 2011

(65) Prior Publication Data

US 2013/0020093 A1 Jan. 24, 2013

(51) Int. Cl.
*E21B 17/07* (2006.01)

(52) U.S. Cl.
CPC ..... *E21B 17/07* (2013.01)
USPC ..... 166/381; 166/242.6; 166/242.1; 166/242.7

(58) Field of Classification Search
CPC ..... E21B 17/07; E21B 43/106
USPC ..... 166/380, 381, 242.6, 242.7, 242.1; 175/320, 321; 267/137, 221, 286
See application file for complete search history.

(56) References Cited

U.S. PATENT DOCUMENTS 5,133,419 A * 7/1992 Barrington ..... 175/321
5,366,013 A * 11/1994 Edwards et al. ..... 166/297
6,290,005 B1 9/2001 Klemm
6,412,614 B1 7/2002 Lagrange et al.
8,408,286 B2 * 4/2013 Rodgers et al. ..... 166/55
2011/0056781 A1 * 3/2011 Morita ..... 188/282.1
2011/0198126 A1 * 8/2011 Swietlik et al. ..... 175/55

FOREIGN PATENT DOCUMENTS

WO 2009030926 A2 3/2009

OTHER PUBLICATIONS

Dongsheng et al. "Measures for power saving and production increase of polymer driven rod pumped wells," China Petroleum Machinery, Apr. 2001. [Abstract Only].
Grzadziela, Andrzej. "Diagnosing Offshore Machines and Power Plants Using Vibration Methods," Sep. 15, 2009. [Abstract Only].
Smolyanitskii et al. "Pressure in Damping Device under Impulse Load," Journal of Mining Science, vol. 37, No. 4, 411-415. [Abstract Only].
International Search Report and Written Opinion, International Application No. PCT/US2012/045684, Date of Mailing Jan. 25, 2013, Korean Intellectual Property Office, Written Opinion 4 pages, Internationa Search report 3 pages.

* cited by examiner

*Primary Examiner* — Nicole Coy
(74) *Attorney, Agent, or Firm* — Cantor Colburn LLP

(57) ABSTRACT

A damping assembly including a damping device including a body, a piston assembly having a piston rod disposed within the body, a biasing member biasing the piston rod to a position within the body, and a damping block connected to and movable with the piston rod; and, a connector associated with a downhole tool and connectable to the damping device; and wherein the damping device reduces effects of shocks experienced by the downhole tool via the damping block. Also included is a method of reducing impact of shocks on a downhole tool during tripping.

21 Claims, 17 Drawing Sheets

DAMPING ASSEMBLY FOR DOWNHOLE TOOL DEPLOYMENT AND METHOD THEREOF

BACKGROUND

In the drilling and completion industry, there is often a need to pull a drill string or other downhole tool out of a borehole and then run it back in, such as to replace a worn-out drill bit, replace a damaged drill pipe or tool, etc. The downhole tool experiences typical impact/shock loading effects when tripping in hole ("TIH"), and may sometimes experience irreparable damage during such tripping.

BRIEF DESCRIPTION

A damping assembly including a damping device including a body, a piston assembly having a piston rod disposed within the body, a biasing member biasing the piston rod to a position within the body, and a damping block connected to and movable with the piston rod; and, a connector associated with a downhole tool and connectable to the damping device; and wherein the damping device reduces effects of shocks experienced by the downhole tool via the damping block.

A method of reducing impact of shocks on a downhole tool during tripping, the method including providing a damping device, the damping device including a body, a piston assembly having a piston rod disposed within the body, a biasing member biasing the piston rod to a position within the body, and a damping block connected to and movable with the piston rod; connecting the damping device to a connector associated with the downhole tool; and, tripping the damping device and downhole tool together in a borehole.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
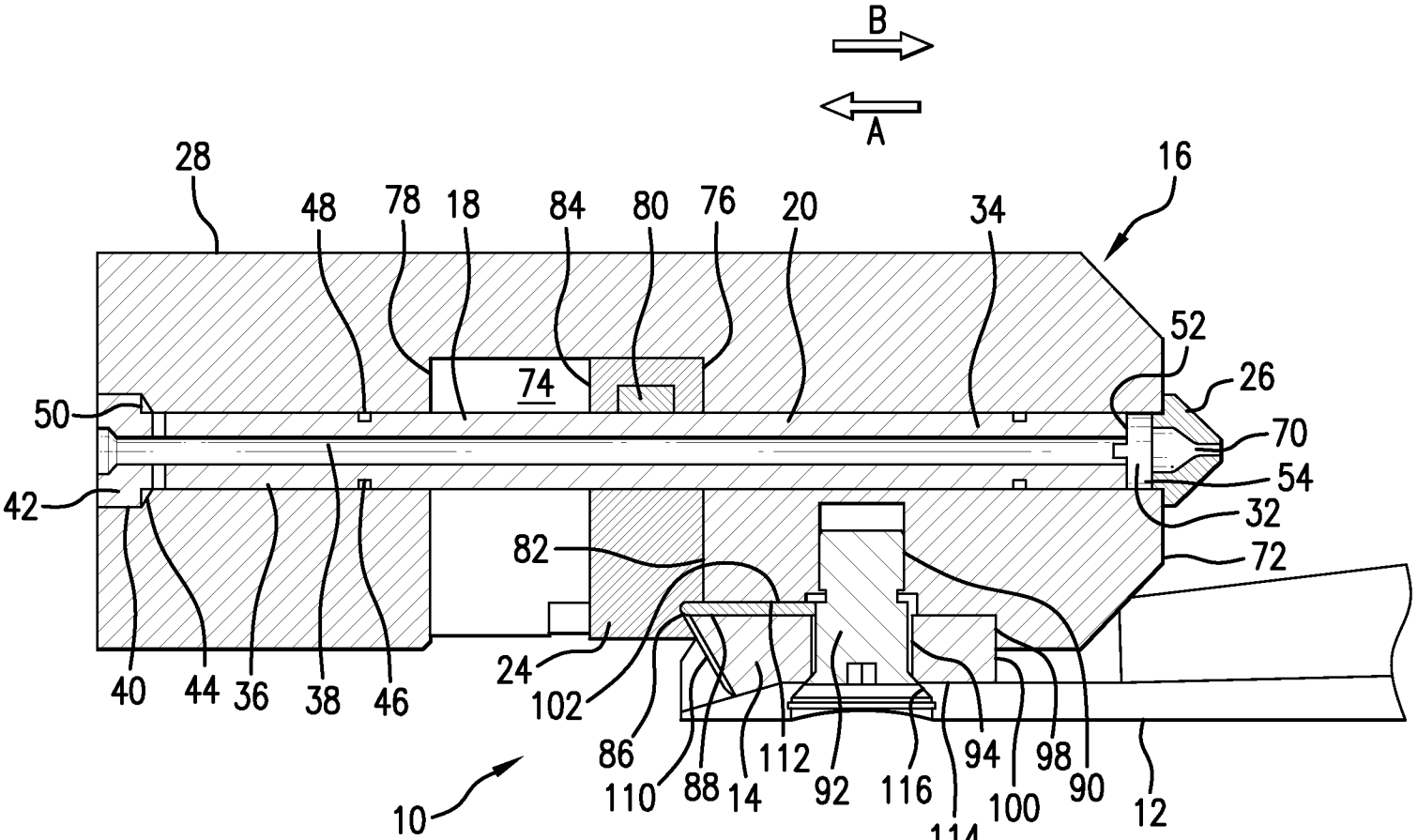
FIG. 1 depicts a cross-sectional view of an exemplary embodiment of a damping assembly for a downhole tool in an attached (unsheared) condition.

A detailed description of one or more embodiments of the disclosed apparatus and method are presented herein by way of exemplification and not limitation with reference to the Figures.

According to exemplary embodiments described herein, a damping device for downhole tool deployment may be used to damp the typical impact and/or shock loads associated with tripping bottomhole assemblies or other downhole tools into and out of the hole. The damping device thus mitigates fatigue failures of tools that undergo cyclic tensile and compressive loading while tripping into and out of the hole.

With reference to FIGS. 1-7, exemplary embodiments of a damping assembly 10 are integrated with various bottomhole assemblies or downhole tools 12 via a connector 14 to decrease the chances of prematurely shearing the connector 14 from the damping assembly 10 while providing shock damping and damage prevention to the bottomhole assemblies. In another exemplary embodiment, the damping assembly 10 may be used as a damping device or as a combined shock damping and downhole tool deployment device.

In one exemplary embodiment, the damping assembly 10 includes a damping device 16 having a piston assembly 18 including a sealed piston 20, a biasing member 22 (FIGS. 5-7), a damping block 24, and a nozzle 26. The sealed piston 20, biasing member 22, damping block 24, and nozzle 26 are all associated with a body 28 that, in some exemplary embodiments, is fashioned with a channel 30 (FIG. 3) that will allow for release of the damping device 16 from the equipment, such as downhole tool 12 and connector 14, to which it was originally intentionally connected, as will be further described below. The body 28 and damping block 24 can be designed such that engagement with variously shaped equipment connections may be achieved, and need not be specifically limited to the design set forth in the exemplary drawings.

The piston assembly 18, including sealed piston 20, is provided within the body 28. The body 28 includes a piston chamber 32 accommodating therein a piston rod 34. The piston chamber 32 extends longitudinally through the body 28, such as, but not limited to, a longitudinal axis of the body 28. The piston chamber 32 includes a piston chamber first section 36 having a first inner diameter substantially matching a first outer diameter of a piston rod first portion 38, and a piston chamber second section 40 having a second inner diameter substantially matching a second outer diameter of a piston rod second portion 42. Because the inner diameter of piston chamber second section 40 is substantially larger than that of piston chamber first section 36, a piston area is formed by this difference in inner diameters. Additionally, a stop surface 44 is formed in the piston chamber 32 between the piston chamber first section 36 and the piston chamber second section 40.

The piston rod 34 includes a peripheral indentation 46 about its outer diameter that receives therein a seal 48, such as an o-ring, for sealing the piston rod 34 within the piston chamber 32. It is within the scope of these embodiments to use any number of peripheral indentations 46 and/or seals 48, including one on the piston rod first portion 38 and one on the piston rod second portion 42. The piston rod 34 includes a piston rod first shoulder 50 that nearly abuts with the stop surface 44 of the piston chamber 32 when the connected downhole tool 12 is in an unsheared condition, as shown in FIG. 1, or when the connector 14 is moved as far in the downhole direction, direction B, as possible if the connector 14 and body 28 are not fixedly connected. The piston rod 34 includes a piston rod first end 52, such as a downhole end, which is positioned closest to a piston chamber first end 54, and a piston rod second end 56, such as an uphole end. While various comparative diameters have been described with respect to the piston rod 34 and the piston chamber 32, it should be understood that these descriptions are provided for describing an exemplary arrangement of the piston rod 34 and piston chamber 32; however, alternate arrangements are also within the scope of these embodiments.

Figure 5:
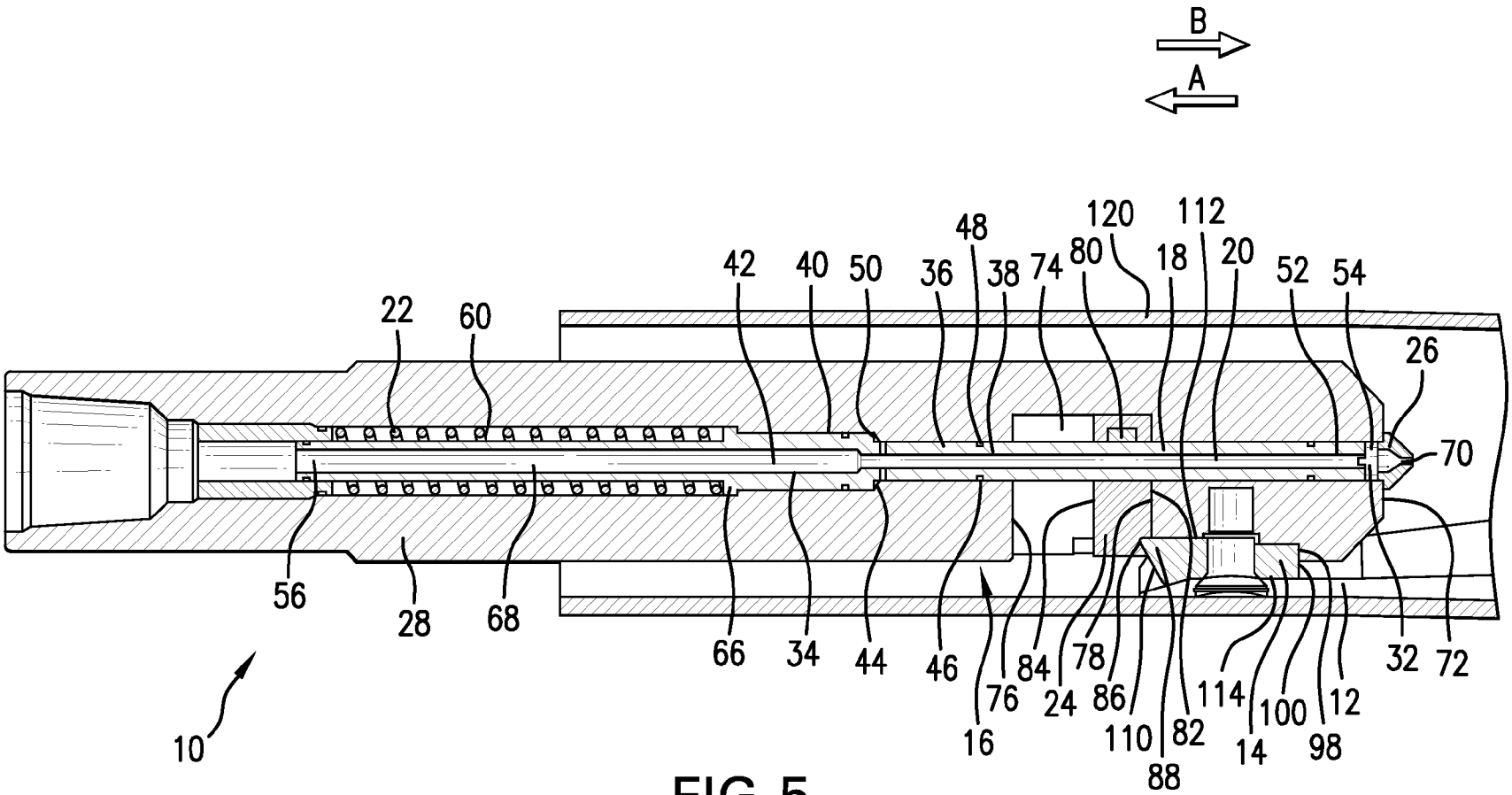
FIG. 5 depicts a cross-sectional view of the damping assembly of FIG. 1 attached to a downhole tool and using an exemplary embodiment of a biasing member.
Figure 6:
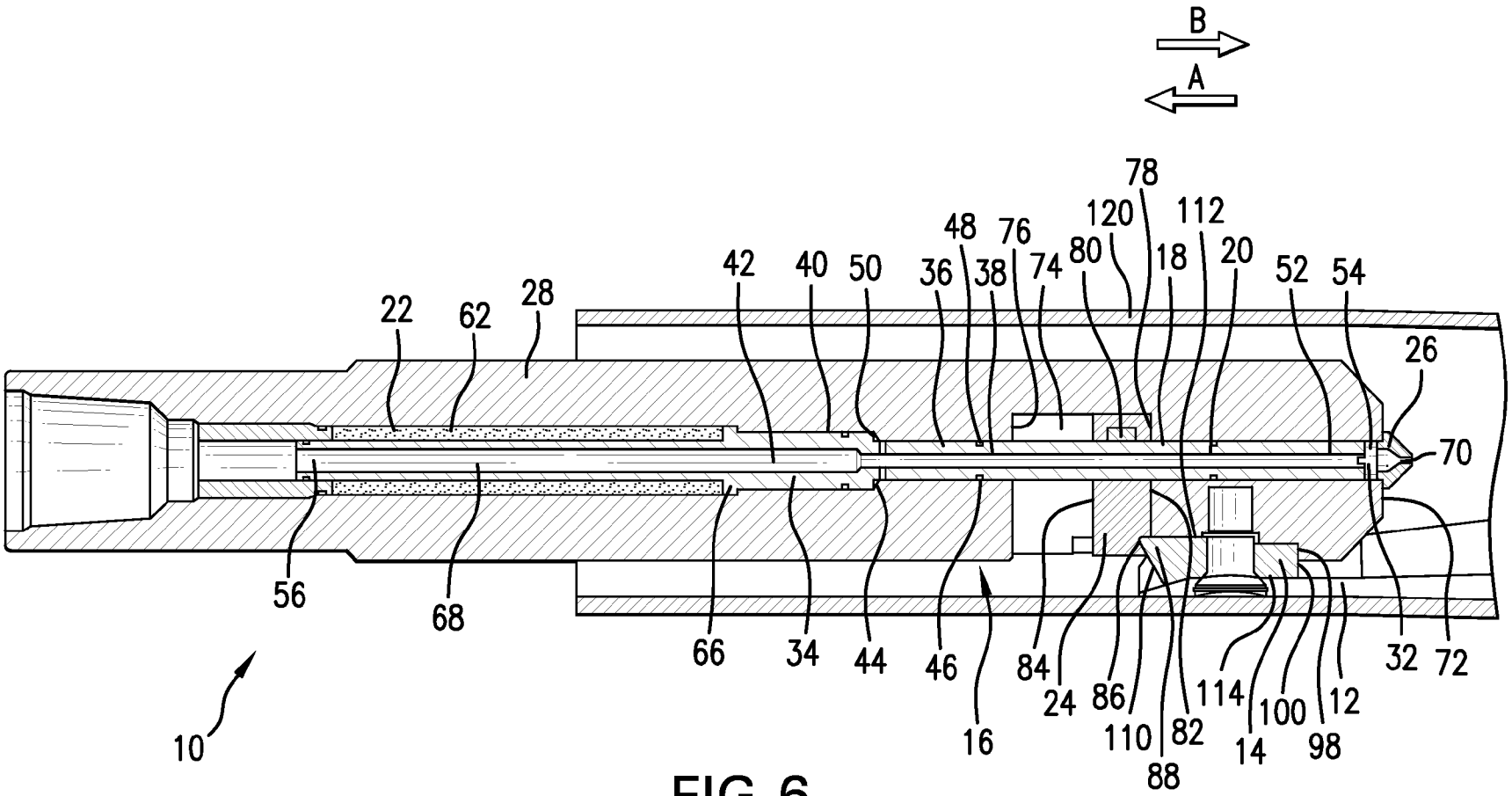
FIG. 6 depicts a cross-sectional view of the damping assembly of FIG. 1 attached to a downhole tool and using another exemplary embodiment of a biasing member.
Figure 7:
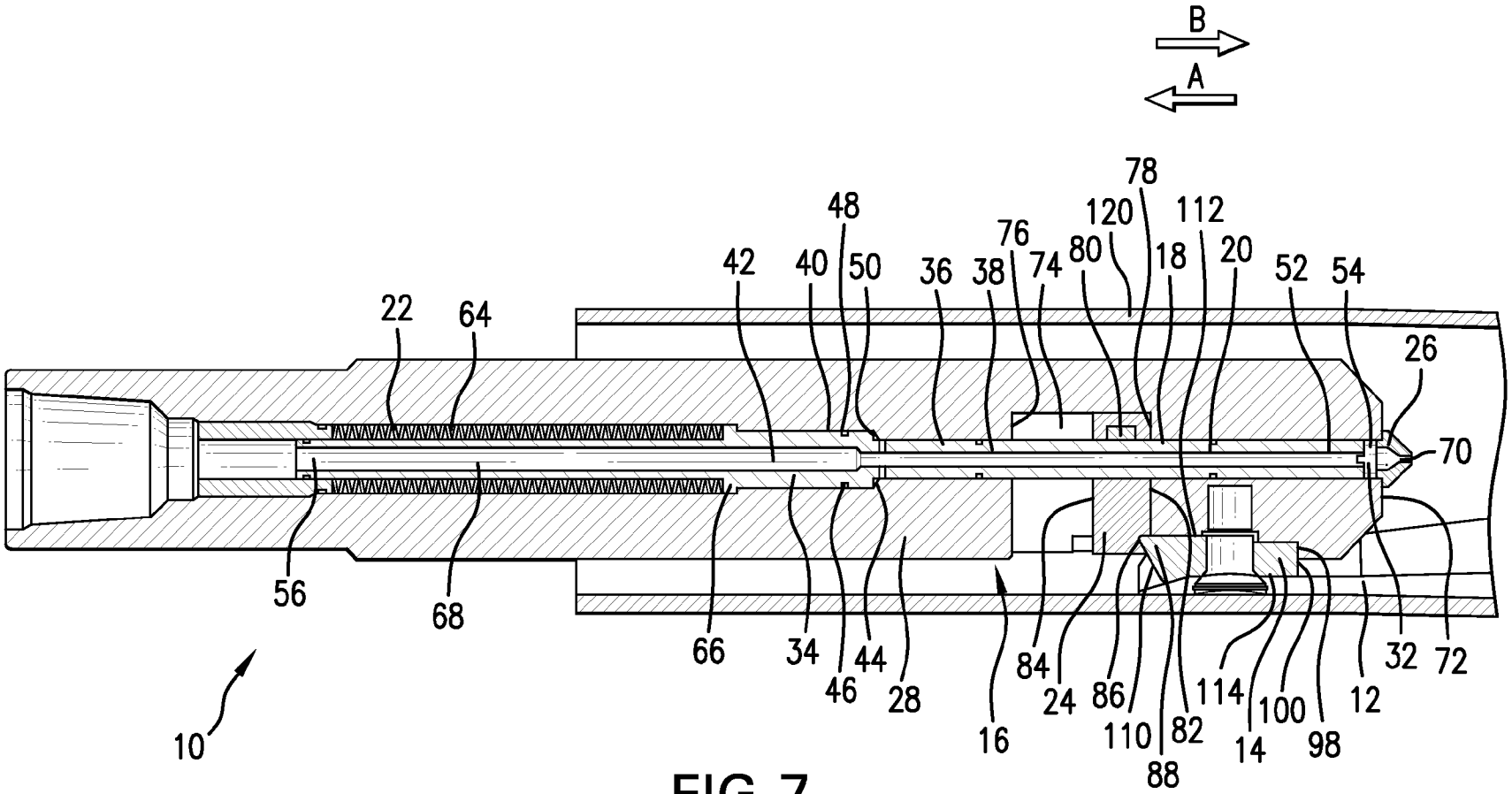
FIG. 7 depicts a cross-sectional view of the damping assembly of FIG. 1 attached to a downhole tool and using yet another exemplary embodiment of a biasing member.

FIGS. 5-7 show various biasing members 22 that are employable with the damping assembly 10. FIG. 5 shows a compression spring 60 for providing a spring-loaded piston, FIG. 6 shows compression fluid 62, and FIG. 7 shows disc springs or spring washers 64. Housed within the piston chamber second section 40, the biasing members 22 push against a piston rod second shoulder 66. A piston rod third portion 68, having a smaller outer diameter than the piston rod second portion 42, may be surrounded by the biasing member 22. While three particular biasing members 22 have been described, other biasing members 22, such as, but not limited to, other spring arrangements and styles of springs, fluidic biasing arrangements, such as magnetorheological fluid, etc., and washer arrangements, such as cone washers, etc., may be used as a biasing member. In another alternate exemplary embodiment of this damping device 16, internally stroking a piston encased in an (oil) fluid laden chamber creates an internal differential pressure effect such that the force holding the damping block 24 against the held/damped object or downhole tool 12 would be released in a more gradual manner With reference again to FIGS. 1 and 2, the nozzle 26 with nozzle opening 70, which opens to the piston chamber 32, is provided at the downhole end 72 of the body 28. The nozzle 26 creates a differential pressure within the piston chamber 32 by limiting flow of fluid in the piston chamber 32 through the nozzle opening 70.

Figure 2:
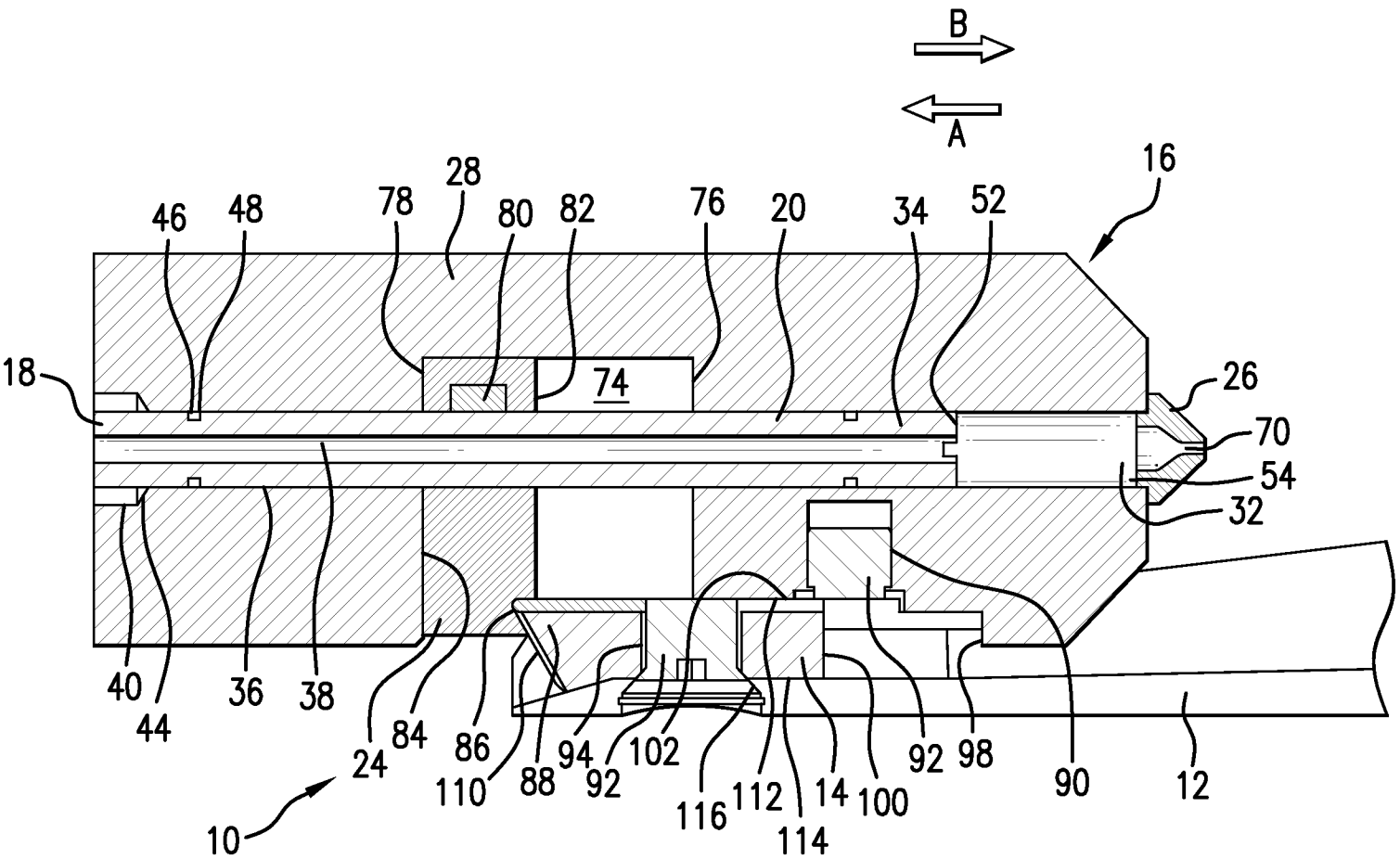
FIG. 2 depicts a cross-sectional view of the damping assembly of FIG. 1 in a semi-released (sheared) condition.

The channel 30, indented within the outer diameter of body 28, is connected to a receiving area 74 having a receiving area first end 76 and a receiving area second end 78 formed to receive therein the damping block 24 such that the damping block 24 is movable in either longitudinal direction, that is from a downhole to an uphole direction (direction A) or from an uphole to a downhole direction (direction B). The damping block 24 is fixed to the piston rod 34, such as via a key 80, so that the damping block 24 moves according to movement of the piston rod 34, and likewise the damping block 24 may force movement of the piston rod 34, as will be further described below. As shown in FIG. 1, in an initial unsheared condition of the damping assembly 10 and downhole tool 12, the piston rod 34, via the biasing member 22, is urged in direction B, and the damping block 24 is likewise urged in direction B. The damping block 24 includes a damping block first face 82 that abuts with and is stopped by the receiving area first end 76. As shown in FIG. 2, in a sheared condition of the damping assembly 10 and downhole tool 12, the damping block 24, via the connector 14, may be urged in direction A to move the piston rod 34 in direction A and compress the biasing member 22. The damping block 24 includes a damping block second face 84 that abuts with and is stopped by the receiving area second end 78 when moving in direction A. The damping block first face 82 includes an engagement feature 86 that engages with the connector 14 that is connected to the downhole tool 12. In one exemplary embodiment, the engagement feature 86 includes an indentation sized to receive a protrusion 88 on the connector 14. However, it would be within the scope of these embodiments to provide alternate engagement features 86, such as, but not limited to, protrusions, shoulders, abutting faces, etc.

In an exemplary embodiment, the body 28 further includes a pin aperture 90 sized to receive a shearing pin 92. The shearing pin 92, which could be a shear screw, is insertable within the pin aperture 90 in the body 28 and within a pin aperture 94 in the connector 14 when the pin apertures 90, 94 are aligned, as shown in FIG. 1. To protect the body 28 from damage, the pin aperture 90 may be lined with a casing. The pin aperture 94 in the connector 14 may also be lined with a casing.

Figure 3:
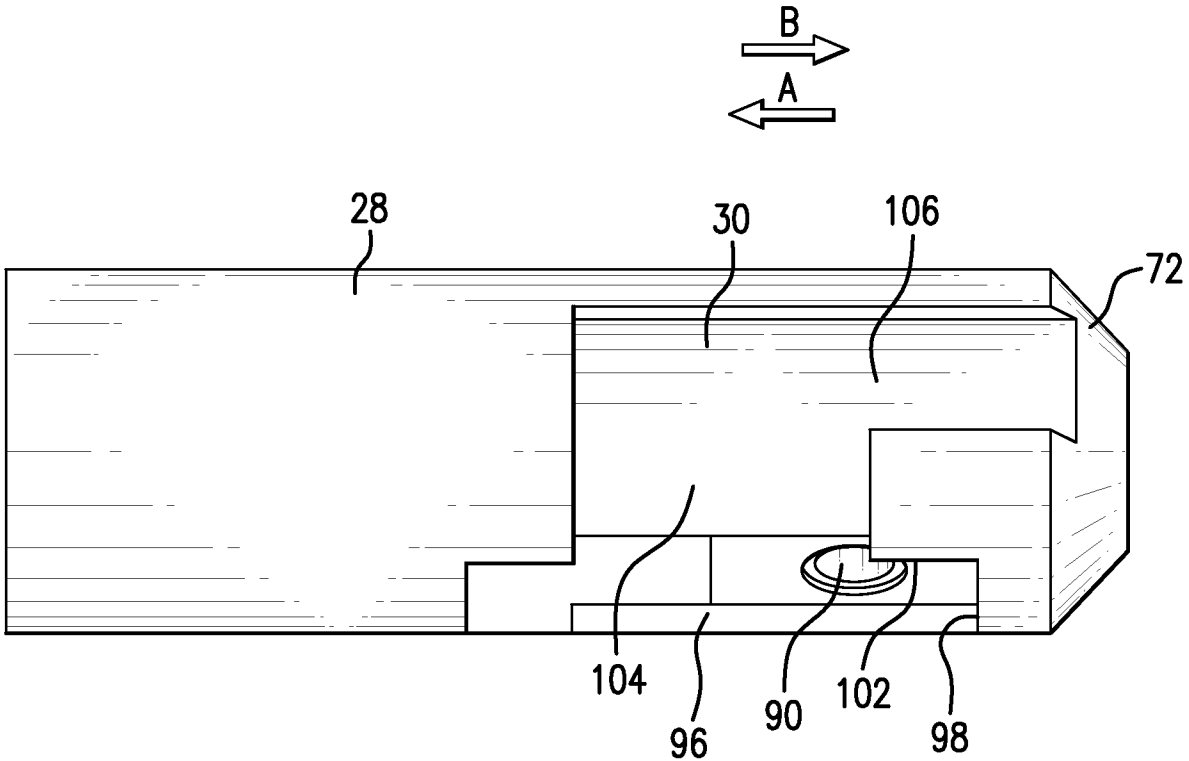
FIG. 3 depicts a plan view of an exemplary embodiment of a body of the damping assembly.
Figure 4:
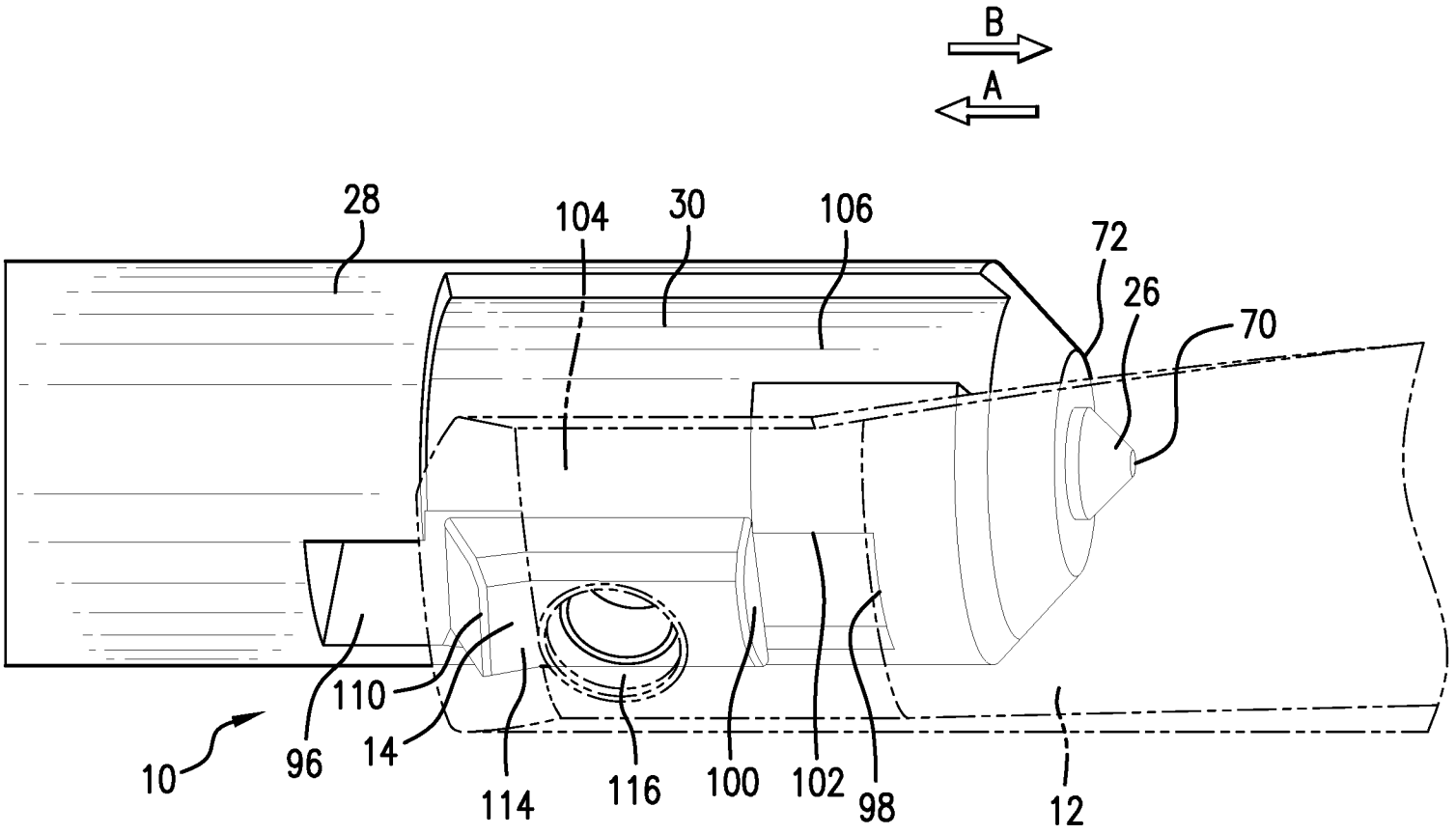
FIG. 4 depicts a perspective view of the damping assembly with an attached downhole tool shown in phantom.

The channel 30, most clearly shown in FIG. 3, slidably receives therein the connector 14. The channel 30 is indented within the body 28 and includes a channel first area 96 for receiving the connector 14 when the connector 14 is either attached via the shearing pin 92 to the body 28 or is sliding within the channel 30 while pushing the damping block 24 in direction A. Therefore, the channel first area 96 is longer than a length of the connector 14. The channel 30 includes a shoulder wall 98 in the channel first area 96, at a downhole end thereof, that abuts with a connector first end face 100 when the connector 14 is fully slid within the channel first area 96 in direction B. The shoulder wall 98 prevents the downhole tool 12 from being prematurely released from the damping assembly 10, even after the shearing pin 92 is sheared. The channel 30 also includes a side stopping wall 102 that prevents the connector 14, and thus the downhole tool 12, from rotating relative to the body 28 when the connector 14 is slid towards the downhole end of the channel first area 96. The pin aperture 90 in the body 28 opens in the channel 30. When the pin apertures 94, 90 in the connector 14 and the body 28 are aligned, such as when the shearing pin 92 is inserted therein, the first end face 100 of the connector 14 may be adjacent to the shoulder wall 98 in the channel first area 96. The channel 30 also includes a channel second area 104 for rotating the damping device 16 with respect to the connector 14 to position the connector 14 out of the channel first area 96. The channel second area 104 is sized to at least accommodate a length of the connector 14 and, via a channel third area 106, is indented to the downhole end 72, as compared to the channel first area 96 which is not indented to the downhole end 72. The connector 14 is sheared from the body 28 and the damping device 16 is moved such that the connector 14 is pushed in direction A, away from shoulder wall 98 and clear of side stopping wall 102, enabling connector 14 to enter the second area 104. The channel third area 106 allows the connector 14, and thus its connected downhole tool 12, to be released from the damping device 16. Unlike the channel first area 96, the channel third area 106 does not include a shoulder wall 98. This allows the release of the connector 14, and connected downhole tool 12 or bottomhole assembly, when the connector 14 slides in channel third area 106 in direction B relative to the damping device 16. It should be understood that the channel 30 may be designed to accommodate a variety of sizes, styles, and shapes of connector 14, and a releasing design other than the above-described first through third channel areas 96, 104, 106 may be employed. Under normal circumstances, the damping device 16 is moved relative to the connector 14 for releasing the downhole tool 12. However, it should be understood that the body 28 of the damping device 16 is movable with respect to the connector 14, and likewise the connector 14 is movable with respect to the body 28; therefore, either movement, or a combination of movements, of the connector 14 and the damping device 16 may accomplish the separation between the connector 14 and the damping device 16.

The connector 14 includes a connector first end 100 that can abut with the shoulder wall 98 of the channel first area 96, and a connector second end 110 that can engage with the engagement feature 86 of the damping block 24. The connector second end 110 may include a corresponding engagement feature, such as protrusion 88, to engage with the engagement feature 86 of the damping block 24. The connector 14 also includes an interior face 112 that slides against the channel 30, and an exterior face 114 fixedly arranged and attached to an uphole end of the downhole tool 12. The interior face 112 may be provided with a radius of curvature that matches that of the channel 30. In one exemplary embodiment, the connector 14 is a separate member attached to the downhole tool 12. In another exemplary embodiment, the downhole tool 12 is designed to include an integrally formed connector 14. The uphole end of the downhole tool 12 may also include a pin aperture 116 for inserting therein the shearing pin 92 when the pin apertures 90, 94 of the body 28 and connector 14, respectively, are aligned. A casing may be inserted within the pin apertures 94 of the connector 14 and downhole tool 12 to protect the downhole tool 12 and connector 14 from damage.

While the damping assembly 10 may be designed to be attachable to a variety of downhole tools 12, bottomhole assemblies, etc., in an exemplary embodiment, the downhole tool 12 may include a whipstock, as shown in FIGS. 1, 2, and 4-7, which is known to one of ordinary skill in the art as having a wedge shape or inclined plane to guide a mill or drill bit towards a borehole wall.

In use, when the damping assembly 10 is connected to the downhole tool 12 via the connector 14, the connector 14 and body 28 of the damping assembly 10 are connected via a shearing pin 92 (FIG. 1) and inserted together into a casing 120 of a borehole, as shown in FIGS. 5-7. It should be understood that the damping assembly 10 could be used in either a casing or within an open borehole application. The damping block 24 is urged against the connector 14 by the biasing member 22, with exemplary biasing members 22 shown in FIGS. 5-7. The force from the damping block 24 against the connector 14 towards direction B reduces the propensity of prematurely shearing the shearing pin 92 (FIG. 1) due to shocks, vibrations, and impacts experienced during tripping into the borehole. Due to such shocks and impacts during tripping, the damping block 24 may experience some bouncing movements in directions A and B; however, the damping block 24 will primarily be urged against the connector 14 by the biasing member 22, via the piston rod 34. To prevent premature shearing of the shearing pin 92, the damping device 16 is used to damp the shock loads that could cause the shearing pin 92, or other shearing mechanism, to fatigue. That is, the shearing mechanism will not be sheared, allowing the connector to move in direction A, until it is meant to be sheared, since the connector 14 would have to overcome both the force required to shear the pin 92 as well as the force of the biasing member 22 pressing against it. In one exemplary embodiment, the force of the damping block 24 in the B direction can be overcome by fluid flowing through the piston chamber 32, and subsequently through the nozzle 26, to create a differential pressure to move the piston-damping block configuration in the direction A away from the held/damped object, downhole tool 12. Once the connector 14 is sheared from the body 28, or is otherwise movable with respect to the body 28, the damping device 16 can be moved either in direction A or B so that the connector 14 is aligned with the channel second area 104. The damping device 16 can then be rotated such that the connector 14 is aligned in the channel third area 106. At that point, the damping device 16 can be pulled away from the downhole tool 12, leaving the downhole tool 12 behind. In an event in which the connector 14 is sheared from the damping device 16, but the downhole tool 12 is not ready to be left behind, the damping device 16 may remain slidably connected to the connector 14 via a dovetail-and-groove feature that may be added to the body 28 and to the held/damped object 12 or connector 14 in order to better control an intended release of the held/damped object 12. In an exemplary embodiment, a dovetail-and-groove feature on the connector 14 and channel 30 may render the downhole tool 12 and damping assembly 10 connected until such time that the downhole tool 12 is ready for release via the channel second then third areas 104, 106, respectively. Until such time of this said release, the damping ability of the damping assembly 10 will remain in effect.

Turning now to FIGS. 8-17, other exemplary embodiments of a damping assembly 200 are shown as integrated with a downhole tool 12 via a connector 14, as in the previous embodiments shown in FIGS. 1-7. Different from the previous embodiments, however, the connector 14 is attached to a damping block 202 via a shearing mechanism, such as a shearing pin 92, instead of to a body 204, thus allowing for damping in both directions A and B until separation is desired.

In one exemplary embodiment, the damping assembly 200 includes a damping device 214 having a piston assembly 206 including a sealed piston 208, a biasing member 210 (FIGS. 15-17), a damping block 202, and a nozzle 26 housed within a body 204. The sealed piston 208, biasing member 210, damping block 202, and nozzle 26 are all associated with the body 204 that, in some exemplary embodiments, is fashioned with a channel 212 (FIG. 10) that will allow for release of the damping device 214 from the equipment, such as downhole tool 12, to which it was originally intentionally connected, as will be further described below. The body 204 and damping block 202 can be designed such that engagement with variously shaped equipment connectors 14 may be achieved, and need not be specifically limited to the design set forth in the exemplary drawings.

The body 204 includes a piston chamber 216 accommodating therein a piston rod 218. The piston chamber 216 extends longitudinally through the body 204 and includes a piston chamber first section 220 having a first inner diameter substantially matching a first outer diameter of a piston rod first portion 222, and a piston chamber second section 224 having a second inner diameter substantially matching a second outer diameter of a piston rod second portion 226. Because the inner diameter of piston chamber second section 224 is substantially larger than that of piston chamber first section 220, a piston area is formed by this difference in inner diameters. Additionally, a stop surface 228 is formed in the piston chamber 216 between the piston chamber first section 220 and the piston chamber second section 224.

Figure 8:
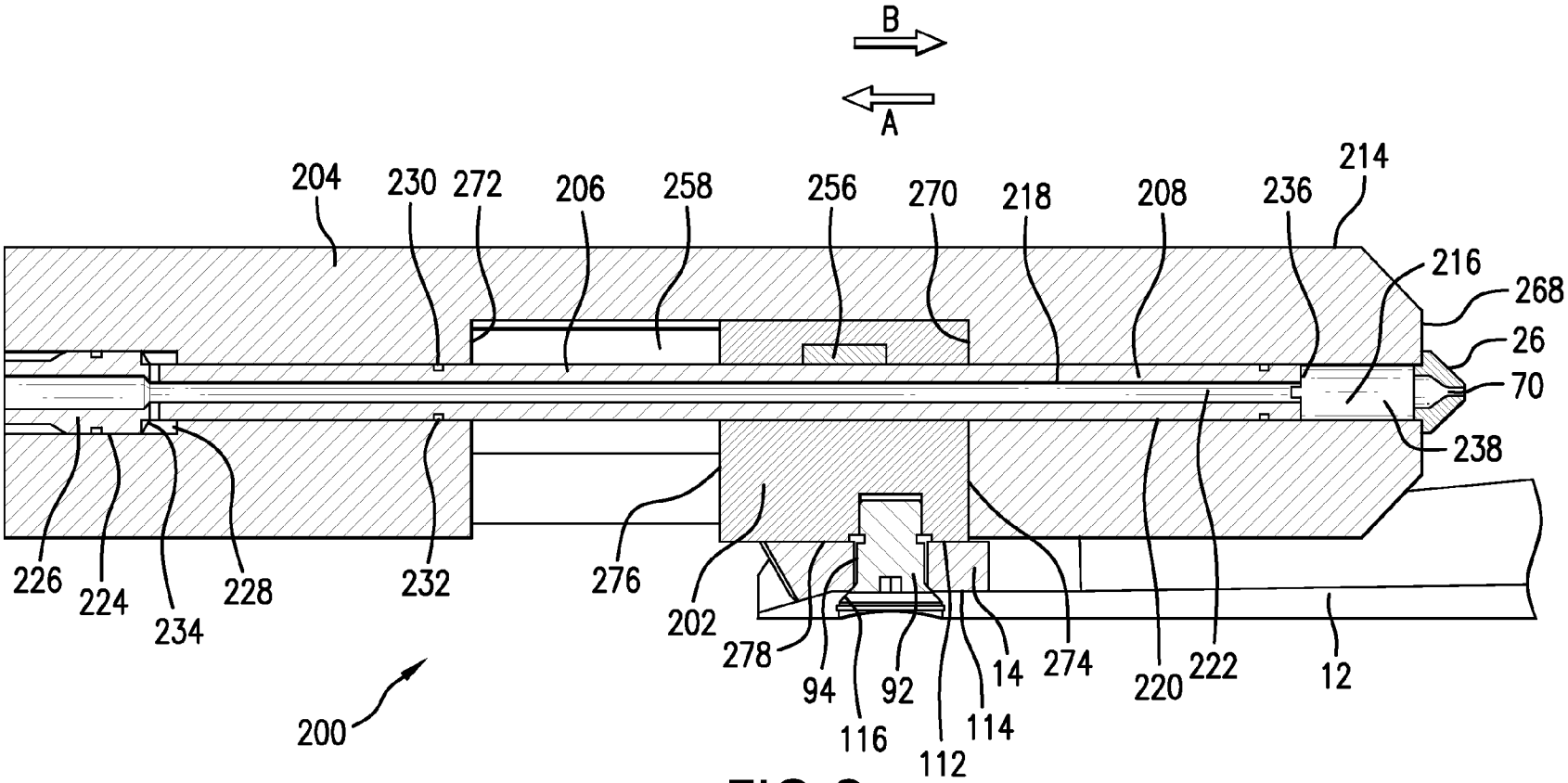
FIG. 8 depicts a cross-sectional view of another exemplary embodiment of a damping assembly for a downhole tool in a first position.

The piston rod 218 includes a peripheral indentation 230 about its outer diameter that receives therein a seal 232, such as an o-ring, for sealing the piston rod 218 within the piston chamber 216. It is within the scope of these embodiments to use any number of peripheral indentations 230 and/or seals 232, including one on the piston rod first portion 222 and one on the piston rod second portion 226. The piston rod 218 includes a piston rod first shoulder 234 that nearly abuts with the stop surface 228 of the piston chamber 216 when the connected downhole tool 12 is moved towards direction B, as shown in FIG. 8. The piston rod 218 includes a piston rod first end 236, such as a downhole end, which is positioned closest to a piston chamber first end 238, and a piston rod second end 240, such as an uphole end (FIGS. 15-17), which is adjacent to a biasing member 210 which urges the piston rod 218 to remain in a certain part of the body 204, as will be further described below. While various comparative diameters have been described with respect to the piston rod 218 and the piston chamber 216, it should be understood that these descriptions are provided for describing an exemplary arrangement of the piston rod 218 and piston chamber 216; however, alternate arrangements are also within the scope of these embodiments.

Figure 15:
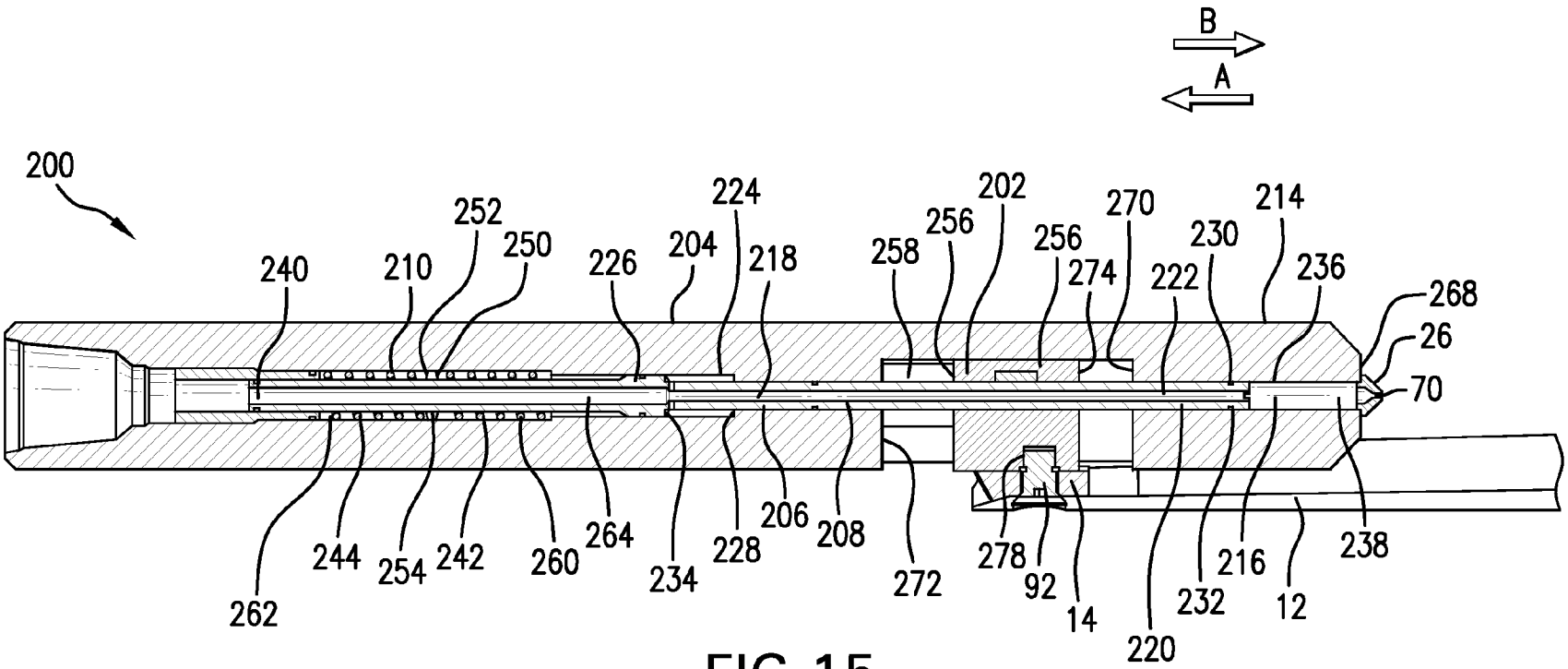
FIG. 15 depicts a cross-sectional view of the damping assembly of FIG. 8 attached to a downhole tool and using an exemplary embodiment of a biasing member.
Figure 16:
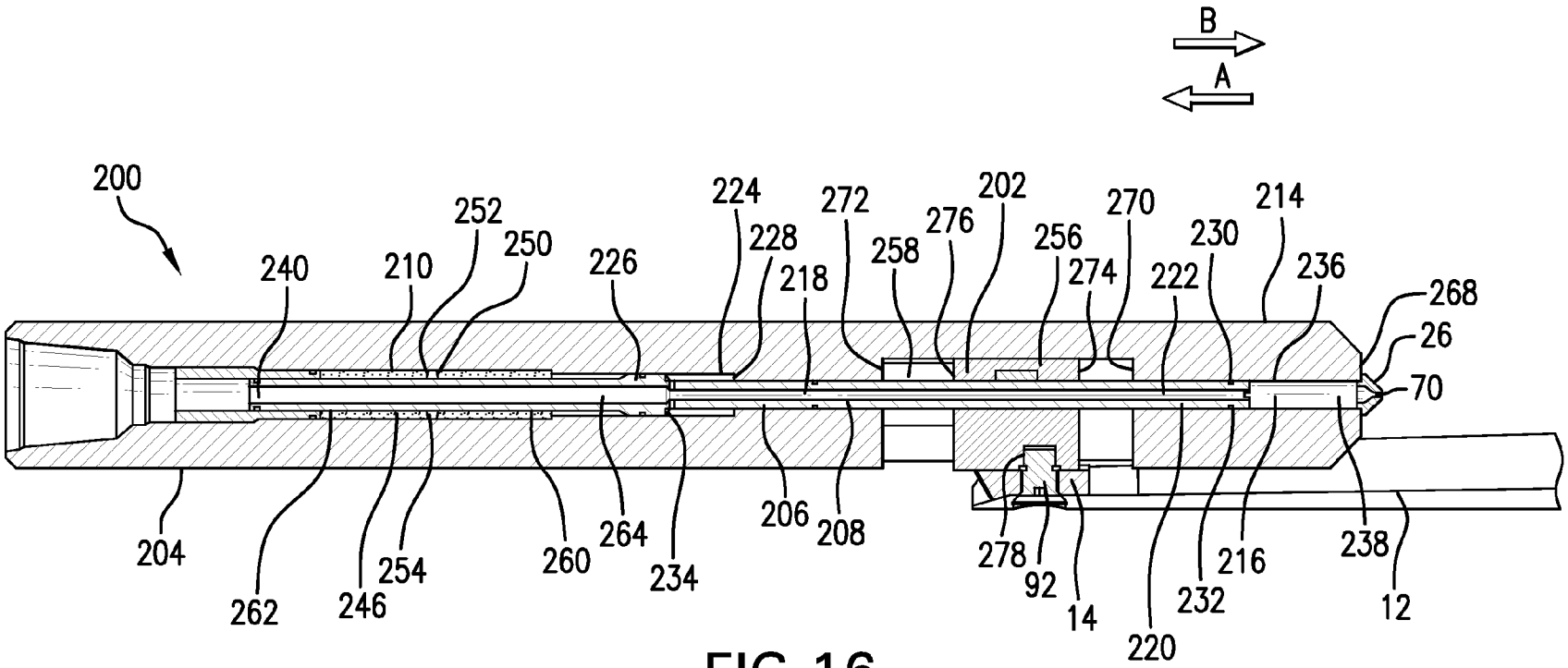
FIG. 16 depicts a cross-sectional view of the damping assembly of FIG. 8 attached to a downhole tool and using another exemplary embodiment of a biasing member; and, FIG. 17 depicts a cross-sectional view of the damping assembly of FIG. 8 attached to a downhole tool and using yet another exemplary embodiment of a biasing member.
Figure 17:
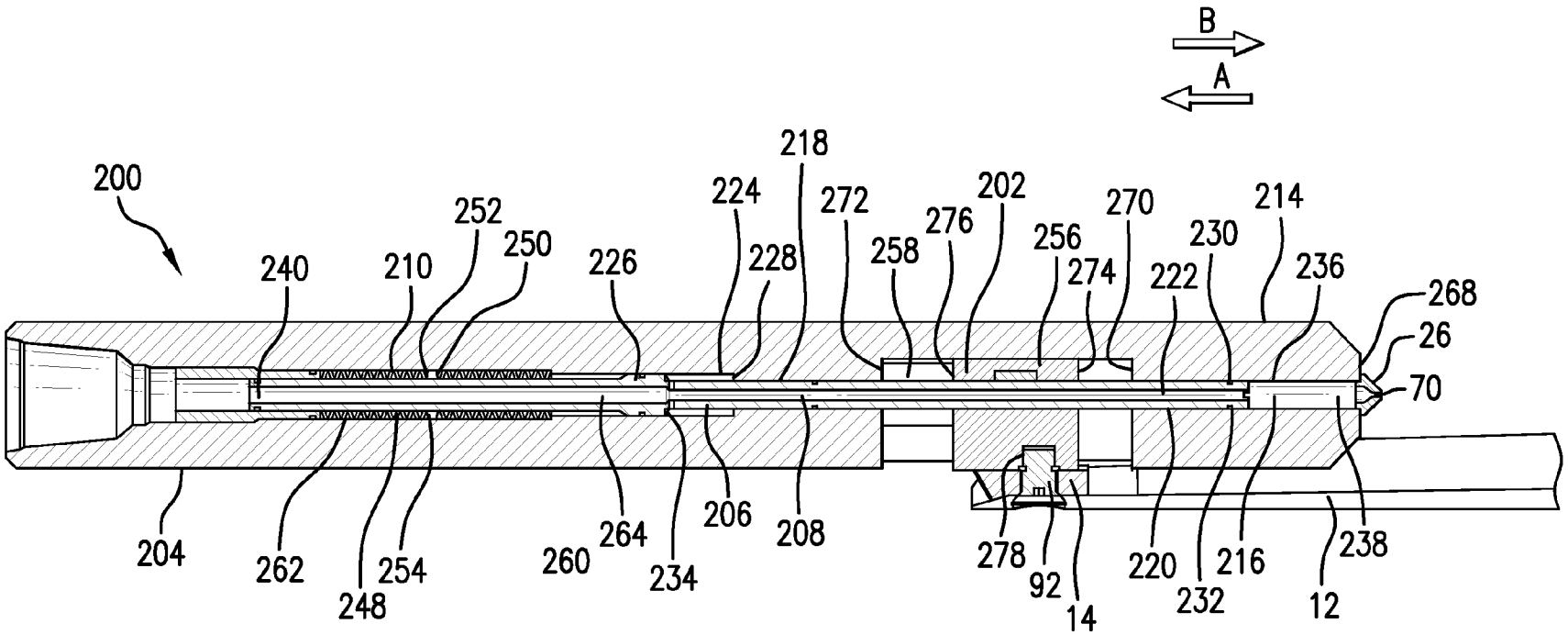

FIGS. 15-17 show various biasing members 210 that are employable within the damping assembly 200. FIG. 15 shows a pair of compression springs 242, 244 for providing a spring-loaded piston, FIG. 16 shows compressible fluid 246, and FIG. 17 shows disc springs or spring washers 248. Housed within the piston chamber second section 224, the biasing members 210 push against opposite first and second sides 250, 252 of a piston rod second shoulder 254. The damping block 202, which is fixed to the piston rod 218, such as via a key 256, may be biased to be disposed in a central area of a receiving area 258 within the body 204 for damping in either direction A or B, and therefore a first biasing member 260 may push against the first side 250 of the piston rod second shoulder 254 towards direction A, while a second biasing member 262 may push against the second side 252 of the piston rod second shoulder 254 towards direction B. A piston rod third portion 264, having a smaller outer diameter than the piston rod second portion 226, may be surrounded by the biasing members 210. While three particular biasing members 210 have been described, other biasing members 210, such as, but not limited to, other spring arrangements and styles of springs, fluidic biasing arrangements, such as magnetorheological fluid, etc., and washer arrangements, such as cone washers, etc., may also be employed.

With reference again to FIGS. 8 and 9, the nozzle 26 with nozzle opening 70, which opens to the piston chamber 216, is provided at the downhole end 268 of the body 204. The nozzle 26 creates a differential pressure within the piston chamber 216 by limiting flow of fluid in the piston chamber 216 through the nozzle opening 70.

Figure 9:
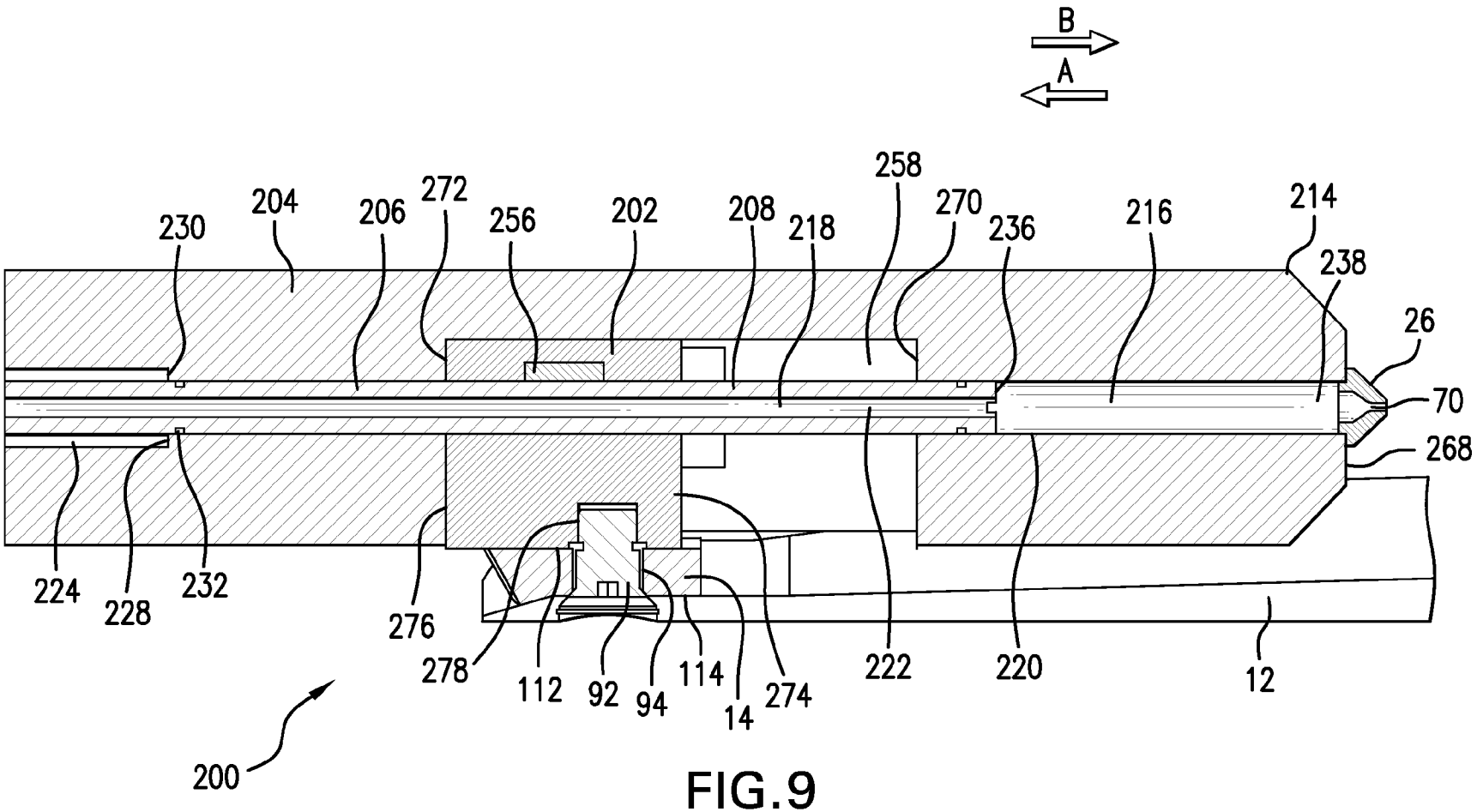
FIG. 9 depicts a cross-sectional view of the damping assembly of FIG. 8 in a second position.

Within the body 204, a receiving area 258 having a receiving area first end 270 and a receiving area second end 272 is formed to receive therein the damping block 202 such that the damping block 202 is movable in either longitudinal direction, that is from a downhole to an uphole direction (direction A) or from an uphole to a downhole direction (direction B). The damping block 202 is fixed to the piston rod 218, such as via key 256, so that the damping block 202 moves according to movement of the piston rod 218, and likewise the damping block 202 may force movement of the piston rod 218, as will be further described below. As shown in FIGS. 15-17, the biasing members 210 settle the damping block 202 to a central area within the receiving area 258 of the body 204 for damping in either direction A and B. As shown in FIGS. 8 and 9, the damping assembly 200 and downhole tool 12 remain in an unsheared condition. In an event in which the downhole tool 12 experiences a shock in the direction B, the connector 14 and damping block 202 will damp the shock in the direction B while urging the piston rod 218 back in direction A. The damping block 202 includes a first face 274 that, when moving in direction B, abuts with and is stopped by a first end 270 of the receiving area 258. In the event the downhole tool 12 experiences a shock in the direction A, the connector 14 and damping block 202 will damp the shock in direction A while urging the piston rod 218 back in direction B. The damping block 202 includes a second face 276 that, when moving in direction A, abuts with and is stopped by a second end 272 of the receiving area 258.

In an exemplary embodiment, the damping block 202 further includes a pin aperture 278 sized to receive the shearing pin 92. The shearing pin 92 is insertable within the pin aperture 278 in the damping block 202 and within a pin aperture 94 in the connector 14 when the pin apertures 278, 94 are aligned, as shown in FIGS. 8 and 9. To protect the damping block 202 from damage, the pin aperture 278 may be lined with a casing. The pin aperture 94 in the connector 14 may also be lined with a casing.

Figure 10:
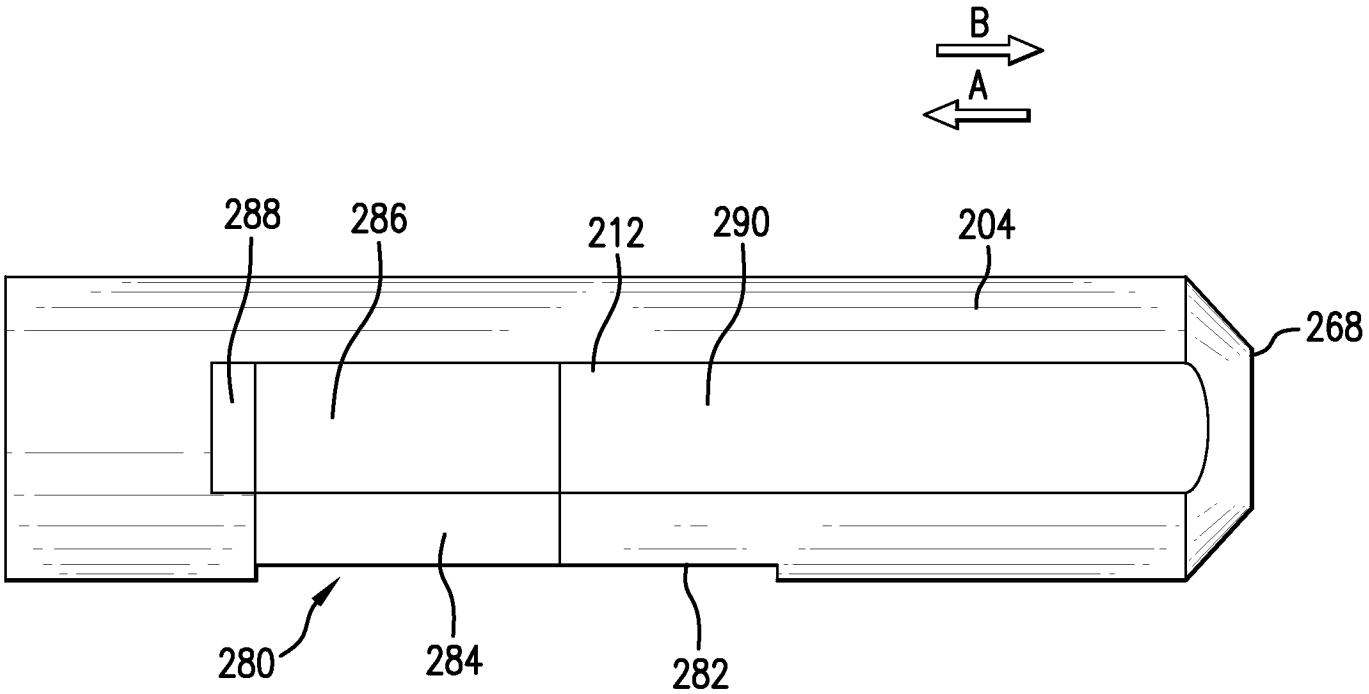
FIG. 10 depicts a plan view of an exemplary embodiment of the body for the damping assembly of FIG. 8.

The body 204 may further include the channel 212 connected to the receiving area 258, most clearly shown in FIG. 10, which slidably receives therein the connector 14. The channel 212 is indented within the body 204 and includes a channel first area 280 for receiving the connector 14 when the connector 14 is sliding within the channel 212 while pushing the damping block 202 in either direction A or B, as shown in FIGS. 8 and 9. Therefore, the channel first area 280 is longer than a length of the connector 14 for the purpose of damping. The receiving area first end 270 prevents the damping block 202, and thus the attached connector 14 and downhole tool 12, from being prematurely released from the damping device 214 when the connector 14 is fully slid within the channel first area 280 in direction B. The channel 212 also includes a side stopping wall 282 that prevents the damping device 214 from rotating relative to the connector 14, and thus the downhole tool 12, when the connector 14 is slid towards a downhole end of the channel first area 280. The channel 212 also includes a channel second area 284 for rotating body 204 such that the connector 14 is positioned out of the channel first area 280 and into the channel second area 284. The channel second area 284 is sized to at least accommodate a length of the connector 14 and is indented from the downhole end 268 as compared to the channel first area 280 which is not indented from this location on the body 204. The channel second area 284 is shorter in length than the channel first area 280. The connector 14 must be pushed further towards direction A, away from receiving area first end 270 and clear of side stopping wall 282, to be able to enter the channel second area 284. The channel 212 also includes a channel third area 286 for allowing the connector 14, and thus its connected downhole tool 12, to be released from the damping device 214. Unlike the channel first area 280, the channel third area 286 does not allow for significant movement of the damping block 202 in either longitudinal direction. The channel third area 286 includes a shearing path 288 which allows entry of the connector 14, but not of the damping block 202, accommodating shearing of the connector 14 from the damping block 202. That is, the shearing is caused by receiving area second end 272 halting the direction A travel of damping block 202 while the connector 14 is allowed to continue traveling in direction A. The shearing path 288 accommodates the shearing of the connector 14 from the damping block 202. Once the connector 14 is sheared from the damping block 202, the damping device 214 may be pulled away from the downhole tool 12, such that the connector 14 follows the release path 290 of the channel third area 286 to the downhole end 268 of the damping device 214. The release path 290 does not include a stopping wall, so the connector 14 can slide off the end. It should be understood that the channel 212 may be designed to accommodate a variety of sizes, styles, and shapes of connector 14, and a releasing design other than the above-described first through third channel areas 280, 284, 286 may be employed.

The connector 14 includes an interior face 112 that abuts against the damping block 202, and an exterior face 114 fixedly arranged and attached to an uphole end of the downhole tool 12. In one exemplary embodiment, the connector 14 is a separate member attached to the downhole tool 12. In another exemplary embodiment, the downhole tool 12 is designed to include an integrally formed connector 14. The uphole end of the downhole tool 12 may also include a pin aperture 116 for inserting therein the shearing pin 92 when the pin apertures 94, 278 of the connector 14 and damping block 202, respectively, are aligned. A casing may be inserted within the pin apertures 94, 116 of the connector 14 and downhole tool 12, respectively, to protect the downhole tool 12 and connector 14 from damage.

While the damping assembly 200 may be designed to be attachable to a variety of downhole tools 12, bottomhole assemblies, etc., in an exemplary embodiment, the downhole tool 12 may include a whipstock, as shown in FIGS. 8, 9, and 11-17, which is known to one of ordinary skill in the art as having a wedge shape or inclined plane to guide a mill or drill bit towards a borehole wall.

Figure 11:
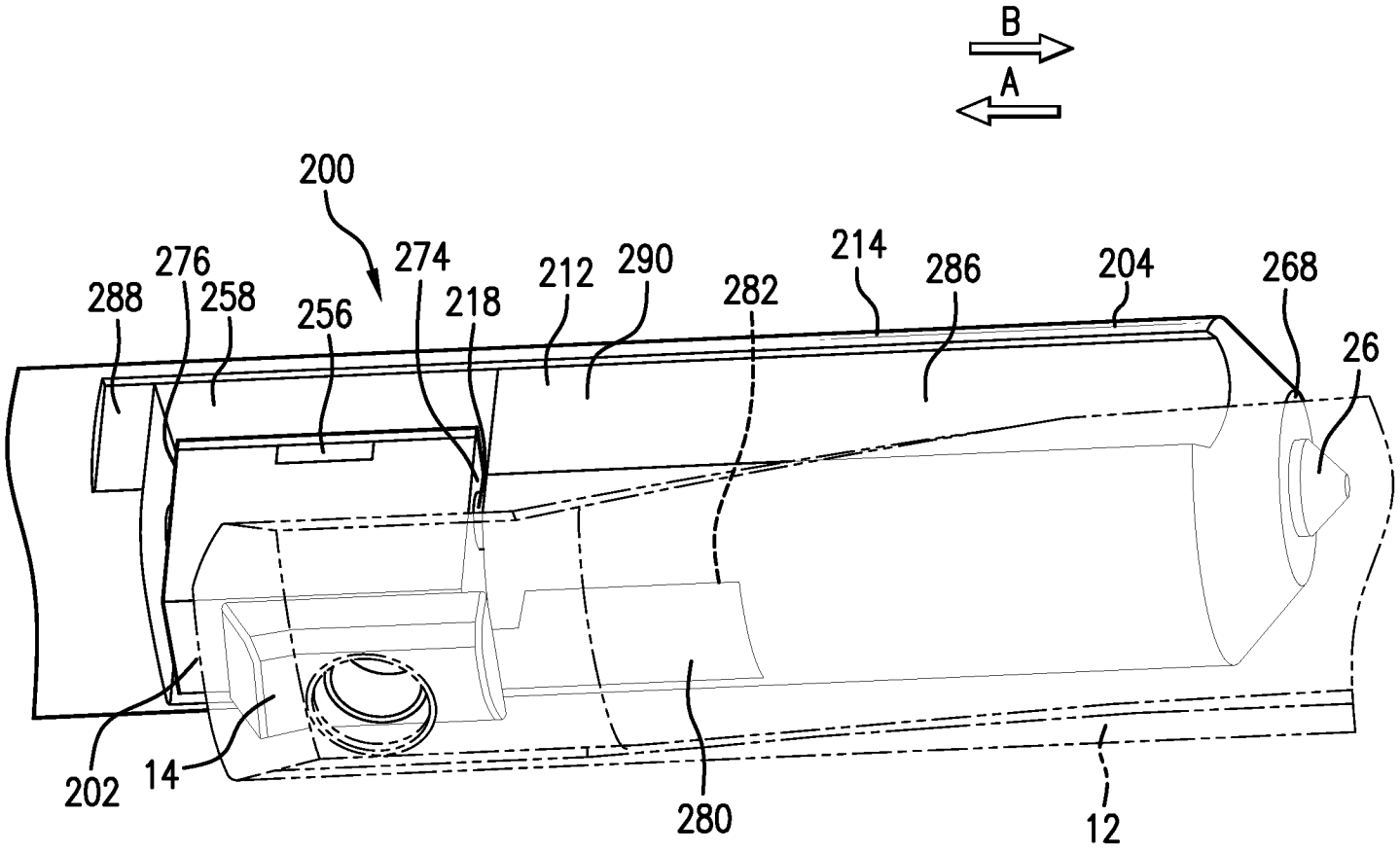
FIGS. 11-14 depict perspective views of the damping assembly of FIG. 8 attached to, and in varying positions with respect to, a downhole tool shown in phantom.
Figure 12:
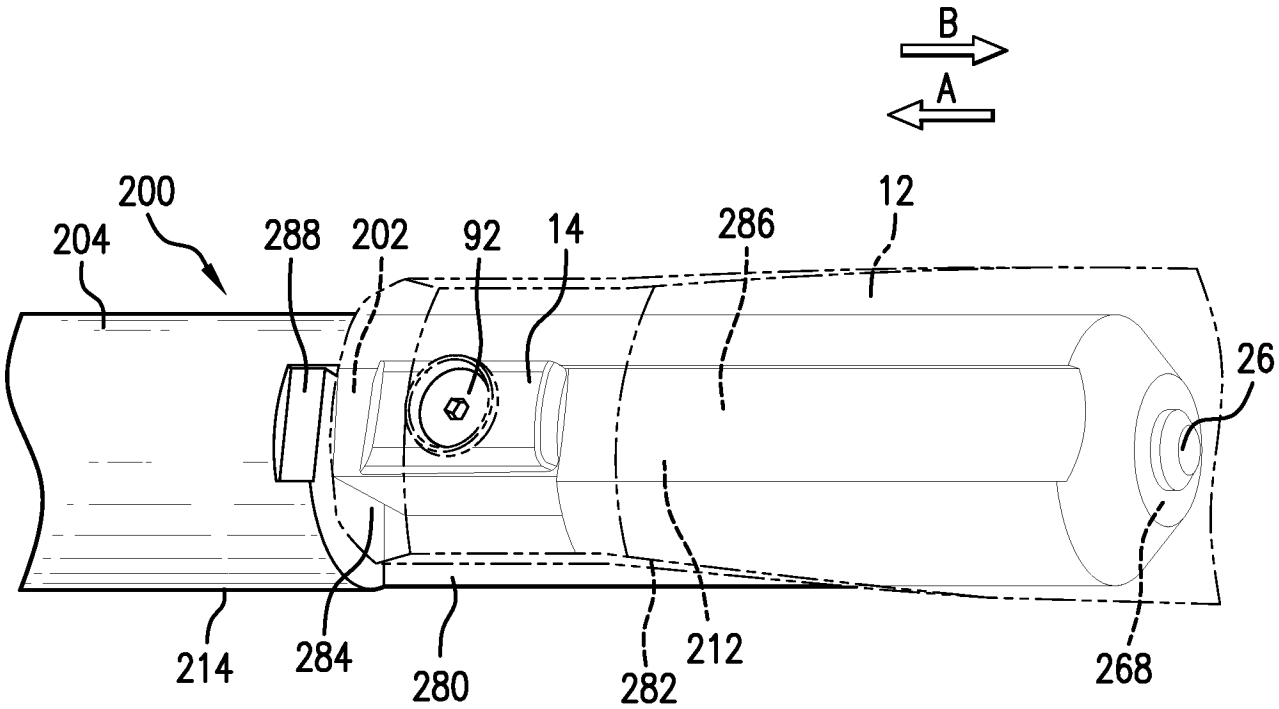
Figure 13:
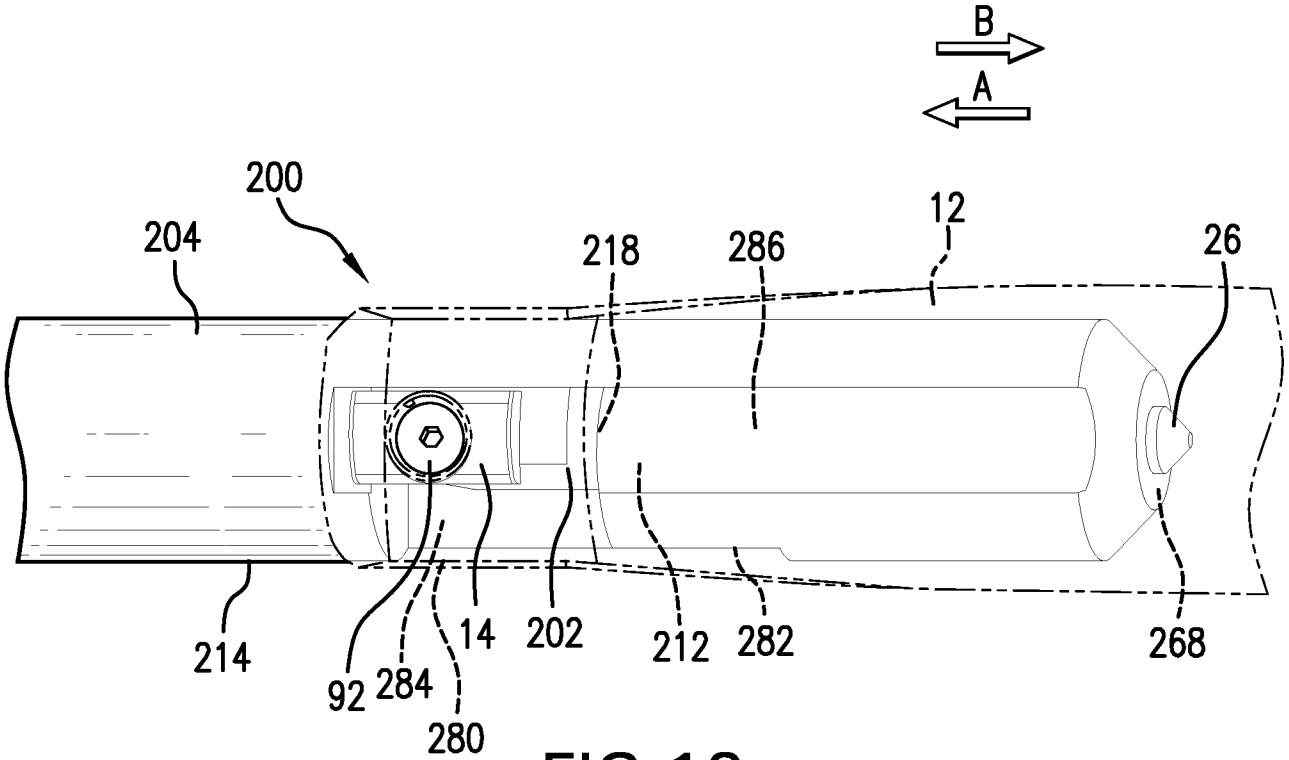
Figure 14:
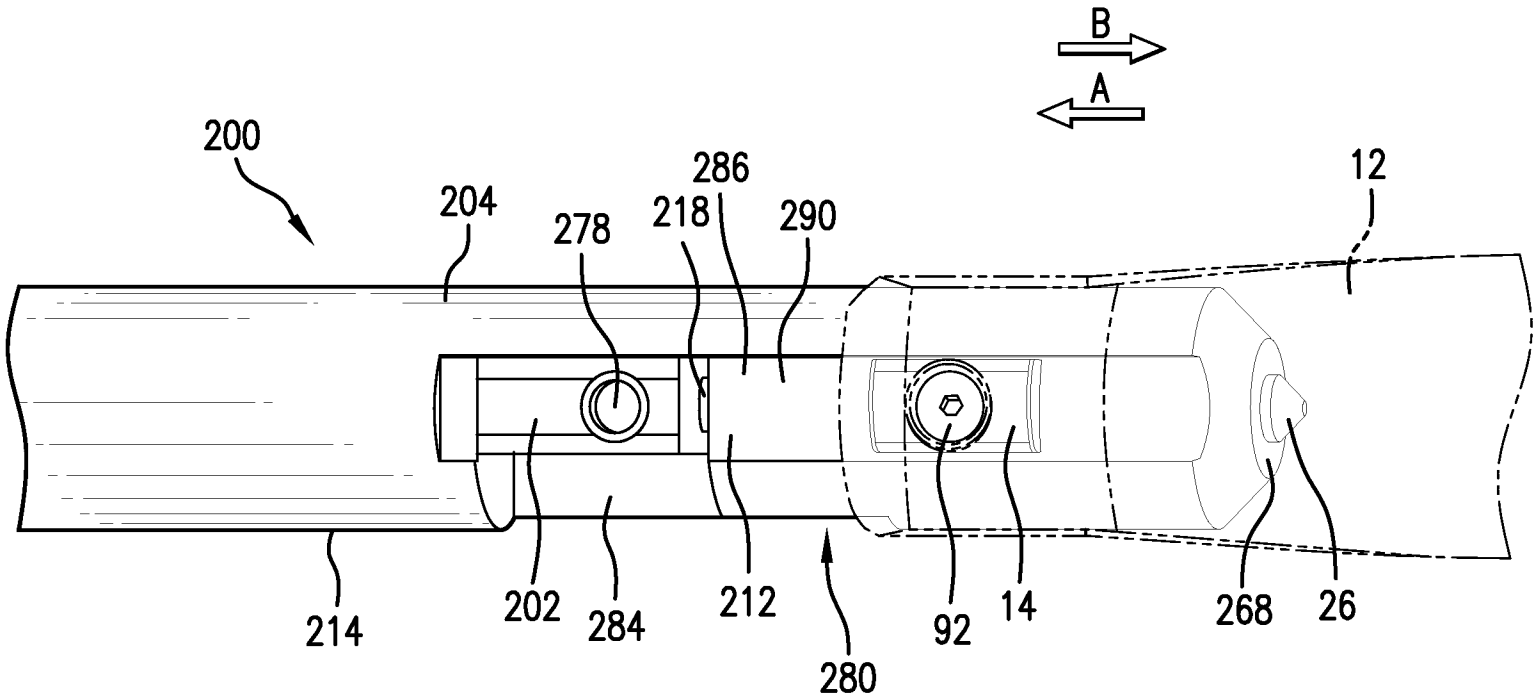

In use, when the damping assembly 200 is connected to the downhole tool 12 via the connector 14, the connector 14 and damping block 202 of the damping assembly 200 are connected via shearing pin 92 and inserted together into a casing of a borehole or directly into the borehole in an openhole application. The damping block 202 is urged in a central region of the receiving area 258, in the channel first area 280, by the biasing members 210, with exemplary biasing members 210 shown in FIGS. 15-17. The downhole tool, as shown in FIGS. 11 and 12, may experience some bouncing movements in directions A and B during tripping into and out of the borehole. Due to such shocks and impacts, the damping block 202 will move accordingly and then be urged back towards the central region by the biasing members 210, via the piston rod 218. To prevent premature shearing of the shearing pin 92 that holds the damping block 202 to the downhole equipment, the damping device 214 is used to damp the shock loads that could cause the shearing pin 92, or other shearing mechanism, to fatigue. When the downhole tool 12 is to be separated from the damping device 214, the damping assembly 200 can be moved in direction B so that the connector 14 is aligned with the channel second area 284. The damping device 214 can then be rotated through the channel second area 284 such that the connector 14 is then disposed in the channel third area 286, as shown in FIG. 12. As shown in FIG. 13, the connector 14 can then be sheared from the damping block 202 by moving the body 204 relative to the downhole tool 12 such that the connector 14 moves into the shearing path 288 away from the damping block 202. At that point, the damping device 214 can be pulled away from the downhole tool 12 and out of the borehole (FIG. 14), leaving the downhole tool 12 behind by allowing the connector 14 to slide through the release path 290 of the channel third area 286. In an exemplary embodiment, the connector 14 is slidably connected to the damping device 214 via a dovetail-and-groove feature that may be added to the body 204 and to the held/damped object 12, or connector 14 in order to better control an intended release of the held/damped object 12. In an exemplary embodiment, a dovetail shape of the connector 14 and groove of the channel 212 may render the downhole tool 12 and damping assembly 200 connected until such time that the downhole tool 12 is ready for release via the channel second then third areas 284, 286, respectively.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A damping assembly comprising:

a damping device including a body having a channel, a piston assembly having a piston rod disposed within the body, a biasing member biasing the piston rod to a position within the body, and a damping block connected to and movable with the piston rod; and, a connector associated with a downhole tool and connectable to the damping device, wherein the connector moves in an uphole direction with the damping block and is longitudinally slidable within the channel during release;

wherein the damping device reduces effects of shocks experienced by the downhole tool via the damping block, and wherein the damping device is separable from the connector within a borehole when the damping device is pulled in a longitudinal direction away from the connector during release.

2. The damping assembly of claim 1, wherein the channel receives the damping block, and the connector is longitudinally slidable within the channel during damping.

3. The damping assembly of claim 2, wherein the channel includes a channel first area having a shoulder preventing the connector from being released from the damping device.

4. The damping assembly of claim 3, wherein the channel further includes a channel second area having a shorter length than a length of the channel first area, and a channel third area adjacent to the channel second area, the damping device rotatable with respect to the connector in the channel second area and releasable from the connector in the channel third area.

5. The damping assembly of claim 4, wherein the connector is fixedly connected to the damping block, the damping device is rotatable with respect to the damping block and the connector when the damping block and the connector are located in the channel second area, and the damping block is releasable from the connector when the connector is located in the channel third area.

6. The damping assembly of claim 2, wherein the connector and channel include a connection with a dovetail-and-groove feature.

7. The damping assembly of claim 1, wherein the biasing member biases the piston rod towards a downhole end of the damping device.

8. The damping assembly of claim 1, wherein the biasing member includes first and second biasing members biasing the damping block to a central region of a receiving area within the body absorbing shocks in opposite directions.

9. The damping assembly of claim 8, wherein the piston rod includes a shoulder with the first biasing member on a first side of the shoulder and a second biasing member on a second side of the shoulder, opposite the first side of the shoulder.

10. The damping assembly of claim 1, wherein the biasing member includes a compression spring.

11. The damping assembly of claim 1, wherein the biasing member includes a compressible fluid.

12. The damping assembly of claim 1, wherein the biasing member includes spring washers.

13. The damping assembly of claim 1, wherein the damping device further includes a nozzle opening to a piston chamber of the piston assembly.

14. The damping assembly of claim 1, wherein the connector is integrally formed with the downhole tool.

15. A damping assembly comprising:

a damping device including a body, a piston assembly having a piston rod disposed within the body, a biasing member biasing the piston rod to a position within the body, and a damping block connected to and movable with the piston rod; and, a connector associated with a downhole tool and connectable to the damping device, wherein the connector and damping device are connected via a shear pin; and, wherein the damping device reduces effects of shocks experienced by the downhole tool via the damping block.

16. The damping assembly of claim 15, wherein the shear pin passes through the body of the damping device.

17. The damping assembly of claim 16, wherein the connector is immovable with respect to the damping device until the shear pin is sheared.

18. The damping assembly of claim 16, wherein the damping block engages with the connector and biases against the connector to prevent premature shearing of the shear pin.

19. The damping assembly of claim 15, wherein the shear pin passes through the damping block of the damping device.

20. A downhole assembly comprising:

a damping device including a body, a piston assembly having a piston rod disposed within the body, a biasing member biasing the piston rod to a position within the body, and a damping block connected to and movable with the piston rod; and, a connector attached to an uphole end of a whipstock, the connector connectable to the damping device;

wherein the damping device reduces effects of shocks experienced by the whipstock via the damping block.

21. A method of reducing impact of shocks on a downhole tool during tripping, the method comprising:

providing a damping device, the damping device including a body, a piston assembly having a piston rod disposed within the body, a biasing member biasing the piston rod to a position within the body, and a damping block connected to and movable with the piston rod;

connecting the damping device to a connector associated with the downhole tool; and, tripping the damping device and downhole tool together in a borehole, the damping device reducing effects of shocks experienced by the downhole tool via the damping block;

selectively releasing the damping device from the downhole tool; and removing the damping device from the borehole while retaining the downhole tool in the borehole.

* * * * *